United States Patent [19]

Lieptz

[11] 3,934,679

[45] Jan. 27, 1976

[54] RETRACTABLE STACKER GUARD

[75] Inventor: Nathan S. Lieptz, Beachwood, Ohio

[73] Assignee: Curtis Noll Corporation, Cleveland, Ohio

[22] Filed: Oct. 21, 1974

[21] Appl. No.: 516,363

[52] U.S. Cl. ..... 187/1 R; 187/9 E; 214/DIG. 7; 280/150 C; 296/107

[51] Int. Cl.[2] ..... B66B 9/00

[58] Field of Search ..... 214/95 R, DIG. 7, 670–674; 212/8 R; 187/1 R, 9 R, 9 E; 280/150 C; 296/107

[56] References Cited

UNITED STATES PATENTS

| | | | |
|---|---|---|---|
| 3,374,909 | 3/1968 | Ferwerda | 212/8 R |
| 3,841,698 | 10/1974 | Stammen | 214/DIG. 7 |
| 3,844,382 | 10/1974 | Mecklenburg | 214/DIG. 7 |

*Primary Examiner*—Robert J. Spar
*Assistant Examiner*—Lawrence J. Oresky
*Attorney, Agent, or Firm*—Isler & Ornstein

[57] ABSTRACT

A retractable overhead guard for use on vertical lifting machines which protects an operator of such equipment from falling objects or material. The overhead guard swings down into protective position in response to vertical load lifting movement by the machine and retracts to a non-obstructing position in response to load-lowering movement of the machine.

15 Claims, 7 Drawing Figures

FIG. 1
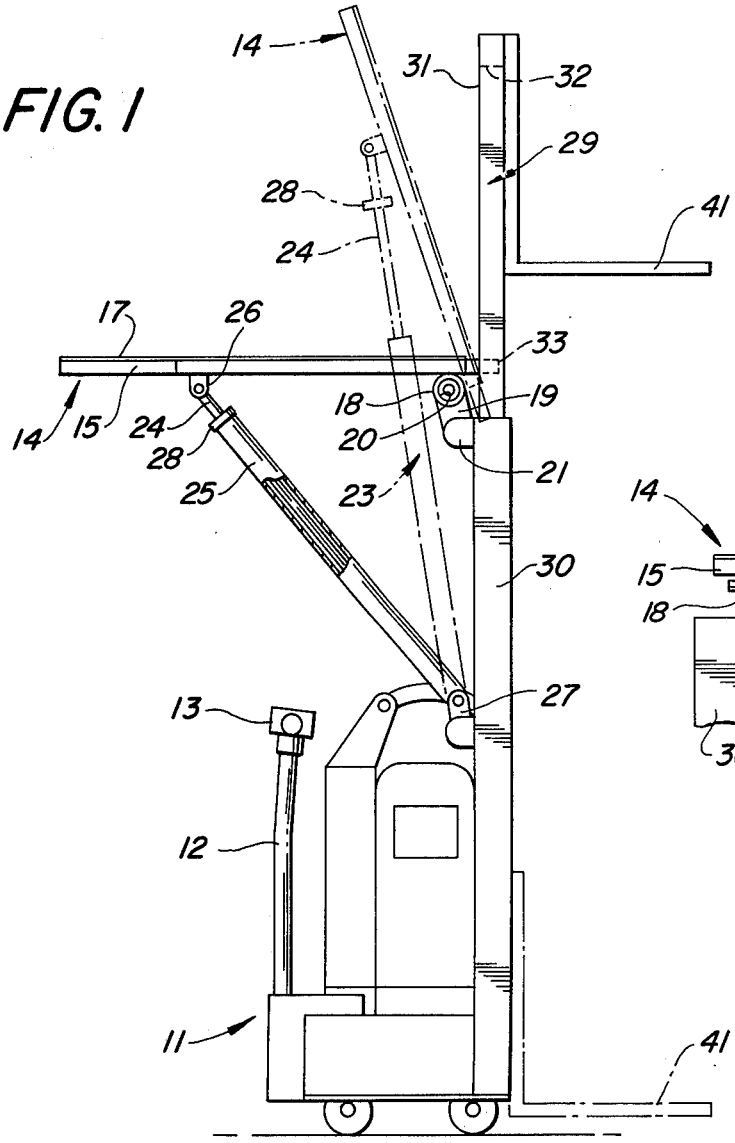
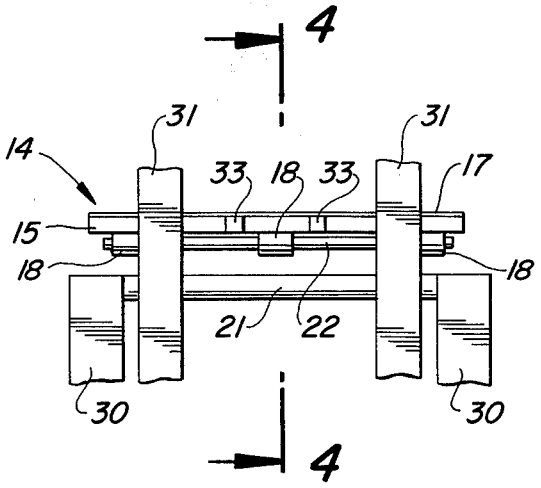
FIG. 3
FIG. 2
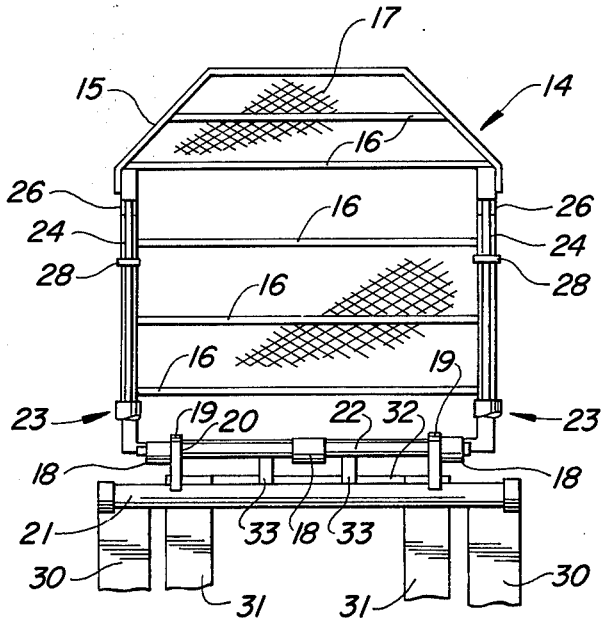

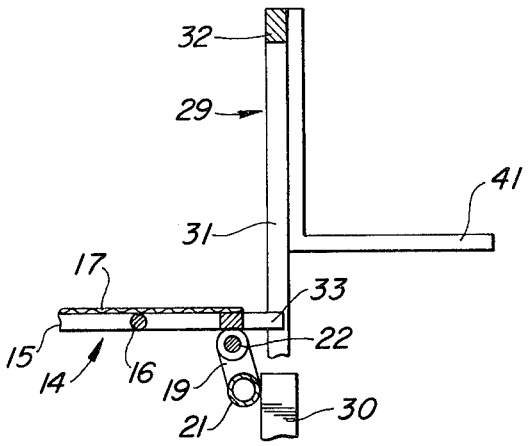
FIG. 4
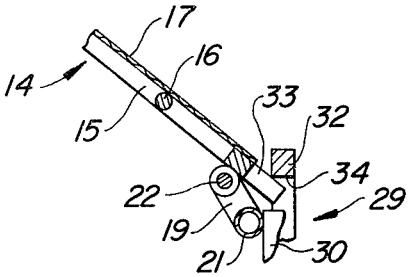
FIG. 5
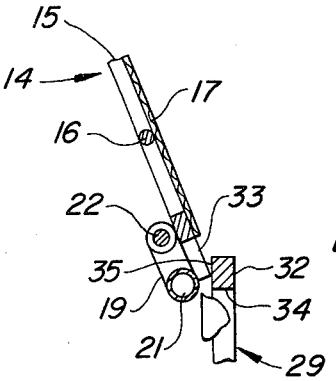
FIG. 6
FIG. 7
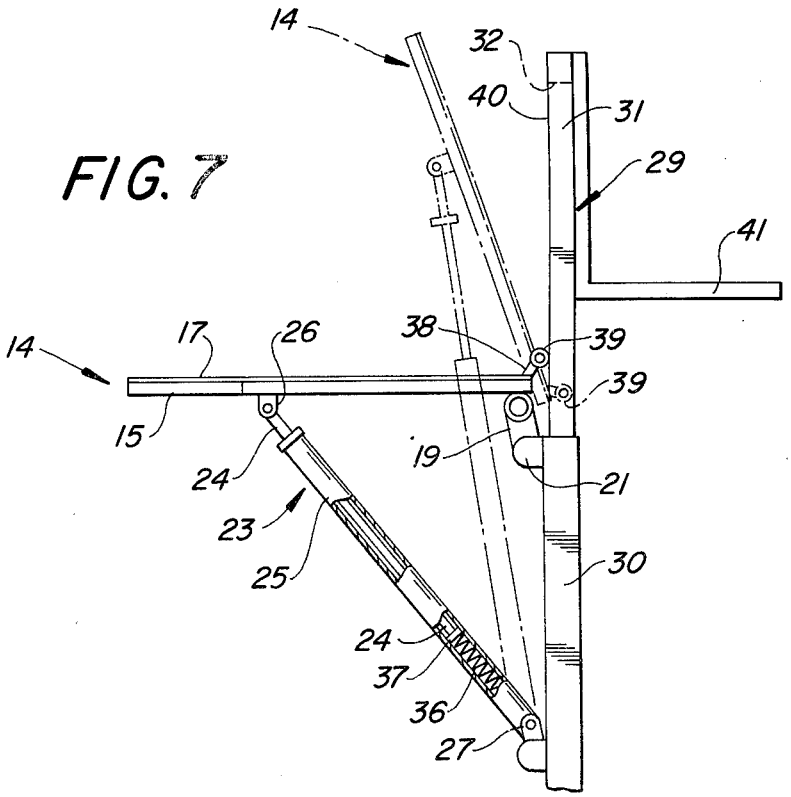

RETRACTABLE STACKER GUARD

BACKGROUND OF THE INVENTION

This invention relates to overhead guards for use on vertical lifting machines, such as warehouse fork lifts or high stackers, where a load is lifted above the head of the machine operator and could present a safety hazard to the operator.

Some vertical lifting machines are of a type where the operator walks behind and controls a steering carriage of a self-propelled apparatus. This manually-operated steering carriage permits the vertical lifting machine to be maneuvered in narrow aisles or other close quarters. Such machines are ordinarily not equipped with overhead guards, as a fixed overhead guard would increase the overall length of the apparatus, thereby significantly limiting its maneuverability.

SUMMARY OF THE INVENTION

The invention provides overhead protection for the operator of a vertical lifting machine during elevation of the load, yet does not add to the length of the machine or diminish its maneuverability in the transport mode.

A primary advantage of the invention is the retractable characteristic of the overhead guard. By having the guard retractable or withdrawable from its protective position, maneuverability of the machine while in a load-lowered position is not reduced by any lengthening projection or extension of the machine beyond its required original length.

An important feature of the invention is that the position of the overhead guard into an operator-protective position is not dependent upon separate operator actuation. The posture of the overhead guard in both the operator-protective and retracted positions is established automatically in response to upward or downward motion of the machine.

Automatic positioning of the overhead guard is achieved mechanically without the need for electric or hydraulic accessory equipment. This feature provides for a high degree of reliability which is important for safe machine operation.

A further advantage of the invention is its rugged construction which provides a reliable shield against falling objects. The degree of structural rigidity can be adapted to suit the requirements of the working environment.

Still another feature of the invention is that the overhead guard is perforated to permit the operator to see the load carried by the machine in an elevated position. Likewise, when the overhead guard has been retracted upward to a non-protective position, the operator can see beyond it for safe steering of the machine.

Another feature of the invention is that it can be fabricated and installed on a fork lift unit or high stacker or other form of lifting machine at a relatively low cost.

It is to be noted that the invention can be utilized on a variety of lifting equipment where overhead protection for the operator is needed and where a fixed overhead guard would interfere with maneuverability of the apparatus or would otherwise create a space problem, regardless of whether the equipment carries the operator or he walks alongside.

Other objects and advantages of the invention will become apparent during the course of the following description and with reference to the following drawings in which like numerals are used to designate like parts throughout the same.

BRIEF DESCRIPTION OF THE DRAWINGS

FIG. 1 is a side elevation of a representative form of lifting apparatus having a retractable overhead guard embodying the features of the invention, with the retracted position in phantom outline.

FIG. 2 is a fragmentary view, as seen from the left side of FIG. 1, showing details of the pivotal connection of the retracted overhead guard.

FIG. 3 is a fragmentary view of the overhead guard in the operator-protective position, as seen from the right side of FIG. 1.

FIG. 4 is a fragmentary cross-sectional view, taken as indicated on line 4—4 of FIG. 3, showing the relationship of the cooperating parts with the apparatus in load-elevating position.

FIGS. 5 and 6 are views similar to FIG. 4 and showing the sequential movement of the guard to retracted position.

FIG. 7 is a fragmentary side elevation showing a modified form of the invention, with a phantom outline of the retracted position of the guard.

DESCRIPTION OF THE PREFERRED EMBODIMENTS

A self-propelled vertical lifting machine 11, such as a warehouse fork lift truck, is provided with a movable steering arm 12 having a switch or electrical control box 13 mounted thereon within convenient reach of the operator. In order to keep the length of the apparatus to a practicable minimum where maneuverability of the apparatus in restricted space conditions is a factor, no provision is made for carrying the operator on the machine. The operator steers and operates the machine while walking or standing behind or adjacent to the arm 12 and its associated control box 13. The machine is equipped with a retractable overhead guard 14 which, in the protective position shown, overhangs the operator to shield him from injury by cartons or objects which may accidentally be dislodged from overhead shelves or from the fork of the machine when it is raised. As best seen in FIG. 2, the overhead guard has a rigid peripheral frame 15 with intermediate spaced support cross members 16 attached thereto and underlying an attached panel member 17. The panel member could be a metal sheet, a wire mesh net, a closely spaced lattice of metal rods, or a grate, etc. It is desirable to use a panel member that is perforated to permit visibility therethrough, permitting the operator to see the work area overhead.

The overhead guard is pivotally connected to a fixed portion of the machine. As best seen in FIGS. 2 and 3, spaced and coaxially aligned tubular journal members 18 are welded to one end of the frame 15. Spaced support brackets or ears 19, having aligned openings 20, are welded to a cross bar 21 of the stationery column of the machine. An axle or shaft 22 extends through the journal members 18 and through the support brackets 19 to pivotally connect the overhead guard to the fixed portion of the machine. Any conventional means, such as cotter pins, can be used to retain the axle or shaft against longitudinal displacement.

A telescopic or extendable strut or brace 23 is provided for the guard 14 in the form of a tube assembly comprising an inner tube or rod 24 slidably contained within an outer tube 25. It is desirable, but not mandatory, that a pair of such braces be utilized in parallel spaced relationship on opposite sides of the overhead guard. The opposite ends of the telescopic assembly are pivoted to the overhead guard and to the machine, as at 26 and 27 respectively.

The telescopic strut has a minimum operating length established by the abutment of one end of outer tube 25 with a stop 28 which is slidably mounted on the rod 24 and adjustably secured thereto. At the selected minimum operating length, the tube assembly acts as a structural support member which arrests further downward angular movement of the overhead guard about the shaft 22. As a structural member capable of carrying loads, the extendable strut 23 enables the overhead guard to withstand impact loads from falling objects.

Adjustment of the position of the stop 28 establishes the angle of rest for the guard and the extent to which it will project in a horizontal direction beyond the nominal periphery defining the inherent length of the lifting machine. If adjustability of the lowered position of the guard is not desired, the adjustable stop 28 may be eliminated and the minimum length of the strut assembly is then determined by a fixed stop or by the abutment between the telescopic components 24 and 25. When the strut 23 has telescoped to its minimum length, the overhead guard is in an operator-protective position, as shown in solid lines in FIG. 1.

As is well known in the art, high-lift fork trucks or stackers are ordinarily provided with one or more slidably movable column assemblies 29 which nest relatively to a fixed column assembly 30. The movable column assembly includes parallel spaced uprights or column members 31 and an integrated cross-member or cross-bar 32 extending across the uprights and functioning as a stay or tie bar. Integrated with the overhead guard and projecting therefrom are one or more extensions or lever arms 33 which project beyond the pivotal connection of the guard and into the path of movement of the cross-bar 32 as it moves between its elevated and its lowered positions.

FIGS. 4–6 show the sequence of operation of the overhead guard in relation to the operation of the lifting machine. FIG. 4 shows the fork 41 of the lifting machine in a raised position. As the load or the fork is lowered, the cross-bar 32 approaches and engages the lever arm or arms 33 to initiate downward camming displacement of the free ends of the lever arms and cause pivotal upward movement or retraction of the guard 14, as indicated in FIG. 5. As cross-member 32 continues its downward movement, as shown in FIG. 6, the cross-bar approaches its lowermost position and the undersurface 34 thereof disengages from the lever arms which now abut the adjacent vertical surface 35 of the cross-bar and are thereby held or restrained against reverse pivotal movement. The overhead guard has thereby been automatically pivoted to its upward or retracted position in response to downward movement of the load-carrying fork of the lifting machine. It will be noted that there is a lost-motion relationship between the lever arms 33 and the cross-bar 32 which permits a substantial downward movement of the movable column 29 and its cross-bar 32 without affecting the operator-protective posture of the overhead guard 14. It is only when the movable column and the fork 41 approach their lowermost positions that the cross-bar 32 engages the lever arms 33 to initiate withdrawal of the guard 14. In its retracted position, the guard 14 does not extend or increase the effective length of the lifting machine and the operator can maneuver the machine around corners and within narrow aisles as easily as if the overhead guard were not present.

When the operator elevates the load, the column assembly 29 and its cross-member 32 move upwardly from the lever-restraining position shown in FIG. 6, allowing the preponderant weight imbalance of the overhead guard rearwardly of the pivot shaft 22 to cause its downward pivotal movement to the extent permitted by the restraining engagement of the cross-member 32 with the lever arm 33, as indicated in FIG. 5. This downward angular displacement of the guard continues until the pivotal movement is arrested by the established limit of telescopic contraction of the strut assembly 23. At this point, the cross-member 32 disengages from the lever arms; the overhead guard is in its operator-protective posture, as shown in FIG. 4; and further elevation of the fork may continue to any desired height without affecting the position of the guard.

Thus, without any required attention from the operator, the overhead guard is automatically lowered into protective position during the initial phase of elevating movement of the lifting machine so that the head and body of the operator will be protected against falling objects which may be dislodged as a result of the lifting and stacking movement. At this point in the operation of the lifting machine, the machine has already been maneuvered into a selected position and any increase in length of the machine which is attributable to the rearward extension of the overhead guard in its horizontal position will not interfere with the stacking function of the machine. After the fork has been lowered, the danger or hazard of operator injury as a result of falling objects is minimized so that the contemporaneous retraction of the overhead guard then permits the lifting machine to be maneuvered to its next destination or function without the increased length that would result from the use of a fixed rearwardly extending overhead guard.

A modification of the invention is shown in FIG. 7. In this modified embodiment, a force-exerting member in the form of a compression coil spring 36 is retained within the outer tube 25 of the extendable strut and reacts against an enlarged end 37 of the rod 24. The force exerted by the energized spring 36 is of a sufficient magnitude to raise the overhead guard to the retracted position.

An extension arm 38 is affixed to the overhead guard at an upwardly directed angle relatively to the plane of the overhead guard. A shoe or roller 39 is attached to the free end of the extension arm 38. Each extension and roller assembly defines a cam which is positioned for abutment with the opposed surface or face 40 of an adjacent column upright 31 when the column 29 is moved upwardly, as shown in solid outline in FIG. 7, but the roller 39 assumes an elevated position projecting above the column 29 and its cross-bar 32 when the column is in its lowermost position shown in phantom outline in FIG. 7.

In the load-lowered position, the roller is free of engagement with the face 40 of upright 31 but does overlie and engage the cross-bar 32 to limit the upward pivotal movement of the guard 14. This upward movement is effected by the action of the spring 36 in yieldably extending the telescopic tube assembly or strut 23. When the fork 41 is raised, the column 29 moves upwardly and the cross-bar 32 cams the roller 39 in opposition to the spring-loaded telescopic struts to cause pivotal displacement of the guard to its operator-protective position. In this position, the roller abuts the opposed column face 40 to prevent any counter-rotation of the guard. Further impact or load-induced downward pivotal movement of the guard is limited by the minimum operating length established for the strut assembly. Downward movement of the guard effects energization of the spring 36 to cause retraction of the guard when the fork is again lowered.

It is to be understood that the forms of my invention, herewith shown and described, are to be taken as preferred examples of the same, and that various changes in the shape, size and arrangement of parts may be resorted to, without departing from the spirit of my invention, or the scope of the subjoined claims.

Having thus described my invention, I claim:

1. In a protective overhead guard for a vertical lifting machine having a vertical mast and having a member guided by and vertically movable on said mast for load-lifting, the combination of an overhead guard pivotally connected to said mast for angular displacement relatively thereto, first means associated with said overhead guard and cooperating with said movable member for raising said overhead guard pivotally to a retracted position in response to downward motion of said movable member, second means associated with said overhead guard and cooperating with said movable member for lowering said overhead guard about said pivotal connection to a substantially horizontal operator-protective position rearwardly of said mast in response to upward motion of said movable member, and third means mounted on said machine for supporting said overhead guard at rest in said operator-protective position.

2. A combination as defined in claim 1, wherein said overhead guard comprises a flat panel member having a rigid peripheral frame.

3. A combination as defined in claim 2, wherein said panel member is perforated for visibility therethrough.

4. A combination as defined in claim 1, wherein said third means for supporting said overhead guard comprises a strut member interposed between said overhead guard and said machine for limiting downward angular displacement of said overhead guard.

5. A combination as defined in claim 4, wherein said strut member comprises an extendable assembly, one end of said assembly being movably attached to said overhead guard in spaced relationship to said pivotal connection, and the opposite end of said assembly being movably attached to said machine, whereby said assembly establishes a minimum load-bearing length for support of said overhead guard.

6. A combination as defined in claim 5, including a movable stop adjustably secured to said strut for selectively establishing said load-bearing length thereof.

7. A combination as defined in claim 5, including a spring compressively retained within said assembly for effecting extension thereof.

8. A combination as defined in claim 1, wherein said first means for raising said overhead guard comprises a lever element engageable by said movable member for translating said downward motion of said movable member into upward angular displacement of said overhead guard about said pivotal connection.

9. A combination as defined in claim 8, wherein said lever element extends to one side of said pivotal connection opposite to the body of said overhead guard, said lever being disposed in the path of movement of said movable member for camming engagement therewith.

10. A combination as defined in claim 9, wherein said body of said guard establishes a weight imbalance about said pivotal connection to provide said second means urging said guard downwardly toward operator-protective position in response to upward movement of said movable member.

11. A combination as defined in claim 1, wherein said first means for raising said overhead guard comprises a force-exerting member acting upon said overhead guard, said force-exerting member operating to raise said guard in response to downward motion of said movable member to a predetermined position.

12. A combination as defined in claim 11, wherein said force-exerting member is a spring energized in response to downward movement of said overhead guard and yieldably urging said guard to retracted position.

13. A combination as defined in claim 11, wherein said second means is a lever element engageable by said movable member for camming said guard into operator-protective position in opposition to said first means.

14. In a protective overhead guard for an operator-controlled vertical load-lifting machine having a longitudinally movable vertical-lifting member, the combination of an overhead guard pivotally connected to said machine for angular displacement relatively thereto, first means associated with said overhead guard and cooperating with said member for raising said guard axially about said pivotal connection to a retracted substantially upright position in response to downward longitudinal motion of said member to a load-carrying position below the operator, and second means associated with said guard and cooperating with said member for lowering said guard axially about said pivotal connection to an operator-protective position in response to upward longitudinal motion of said member toward a load-carrying position above the operator.

15. A combination as defined in claim 14, including guard-support members for limiting downward pivotal movement of said guard to a predetermined position.

* * * * *